United States Patent [19]

Muller

[11] Patent Number: 4,754,960

[45] Date of Patent: Jul. 5, 1988

[54] DUAL MODE COPIER DOCUMENT WORK STATION AND WEB GUIDE

[75] Inventor: George A. Muller, Rochester, N.Y.

[73] Assignee: Xerox Corporation, Stamford, Conn.

[21] Appl. No.: 31,646

[22] Filed: Mar. 30, 1987

[51] Int. Cl.[4] ..... B65H 1/04; B65H 23/00

[52] U.S. Cl. ..... 271/9; 271/145; 108/92; 400/605; 400/613.2; 400/613.4

[58] Field of Search ..... 271/9, 145; 108/92; 312/198; 211/59.2; 400/605, 613.2, 613.4; 226/196; 270/39; 355/3 SH, 14 SH

[56] References Cited

U.S. PATENT DOCUMENTS

| | | | |
|---|---|---|---|
| H. 17 | 2/1986 | Wenthe, Jr. | 226/76 |
| 1,615,894 | 2/1927 | Waldheim | 400/613.2 X |
| 3,255,662 | 6/1966 | Call | 88/24 |
| 3,888,584 | 6/1975 | Smith | 355/75 |
| 4,320,960 | 3/1982 | Ward et al. | 355/14 R |
| 4,408,916 | 10/1983 | Burgert | 400/613.2 |
| 4,485,949 | 12/1984 | Gebhart et al. | 226/2 |
| 4,488,829 | 12/1984 | Hidaka | 400/605 |
| 4,515,490 | 5/1985 | Marker, III | 226/196 X |
| 4,526,309 | 7/1985 | Taylor et al. | 226/33 |
| 4,540,395 | 9/1985 | Bekooy | 493/410 |
| 4,579,449 | 4/1986 | Leroy | 355/3 SH X |

*Primary Examiner*—F. J. Bartuska
*Assistant Examiner*—Edward S. Ammeen

[57] ABSTRACT

For a copier with a dual mode document handling system for handling both computer forms web (CF) and individual document sheets, there is provided a plural mode integral unit system easily mountable to an end of the copier for handling the input and/or output of both types of documents and providing improved work space. The system includes a first document stacking tray providing both an operator work space and a tray for individual sheets fed to or from the copier document feeder, and also defining a CF guide aperture therein for CF document feeding to or from the document feeder. The system also includes an integral second document stacking tray for properly supporting a fan-folded stack of CF in a operating position. This second tray is pivotally mounted to the first tray and compactly closable thereunder without interfering with the operation of the first tray to provide an attractive and compact closed unit. The second tray is repositionable into a substantially horizontal operating position appropriately spaced below the first surface and centrally below the CF guide aperture and in CF feeding communication therewith for improved CF feeding/stacking. A simple suspension system is provided to suspend the second tray in the operating position from the first tray so that it does not have to cantilever support the weight of the CF stack.

2 Claims, 3 Drawing Sheets

DUAL MODE COPIER DOCUMENT WORK STATION AND WEB GUIDE

The present invention relates to improved apparatus for the stacking and transporting of computer form or the like web documents to or from a copier imaging station, and, more specifically, to a low-cost and compact plural mode document handling accessory for a copier for compatible handling of individual document sheets and web documents and optionally providing a work station.

As further discussed below, it is now known and desirable to provide copiers with a dual mode document feeder or interchangeable feeders capable of high speed feeding for copying of either conventional sheet documents or computer form web (CF) documents. Thus, operatorconvenient and reliable stack feeders and restackers for both forms of documents are desirable and needed. Examples of copiers with a dual mode document feeder are the Xerox "1090" copier and others shown and described in patent references herein and in copending commonly assigned U.S. application Ser. No. 029,027 filed Mar. 23, 1987 by Thomas Acquaviva entitled "Automatic Dual Mode Sheet and Web Document Transport For Copiers" which is hereby cross-referenced.

The system disclosed herein provides significant advantages in ease of operation, reliability, cost, and appearance over various present document feed-in or feed-out guide and tray arrangements for computer form web (CF) documents. It is usable for either the input or output of documents to various document feeders. Furthermore, it also provides a low cost "dual mode" system which is usable for either or both regular documents, i.e., plural individual cut sheet documents, or an elongate web document, such as a fan-folded computer form web document. It also provides some of the advantages of the CF restacker of U.S. Pat. No. 4,540,395 by Jan Bekooy, in that it also provides positive, central, input positioning and control of the CFF web at a proper orientation and distance above the CF stack. This is provided at no additional cost or loss of other function here by a properly positioned aperture in a dual mode tray.

There are even further advantages to the disclosed system. Unlike conventional "wing" trays attached to the document feeder, which throw documents or other papers on the floor when the document feeder is lifted, and cover up (overlies) otherwise usable work space on the top surface of the copier, the plural mode upper tray member disclosed herein also provides a stationary and usable work surface extension, desirably contiguous rather than overlying the top surface of the copier. Integral and operatively associated with this dual mode tray member is a CF tray portion for which the dual mode tray provides a CF guide. Furthermore, this integral CF tray portion is readily pivotably closeable against the dual mode tray portion to provide a much more attractive "contoured" machine appearance, with no increase in overall machine size. Also, the CF tray portion of the unit disclosed herein is supported rather than cantilevered, which is desirable in view of the considerable weight of a large stack of CF. Yet the entire unit is readily hung onto an end of the copier. It is readily removable therefrom, but desirably may be left on all the time.

In contrast to some previous designs, as for said Xerox "1090" copier, separate wire-form CF stacking trays are not required. The cost, space, operator mounting and removal and undesirable appearance of these large wire baskets or trays and their copier-mounting hardware are all eliminated. For CF the "1090" copier is equipped with an end panel to which a wire-form CF tray is permanently attached and always visible, even when folded up against the end panel when not in use. Furthermore, in said Xerox "1090" copier, for example, an upper tray or work station for normal documents has to be folded down out of the way by the operator to provide for CF feed-out (restacking) into the separate wire-form CF basket, and the CF web feeds out an uncontrolled manner over the end edge of the copier at the folded down upper tray. Thus the CF web output may miss the wireform CF tray and fall onto the floor rather than properly restack.

If such separate wire-form CF stacking units are of the removable type, then they need separate storage space, and may become lost. Likewise, each time single purpose removable CF trays are required they must be located, unfolded, and attached to the copier by the operator.

The Xerox "1090" copier has no separate CF web document input tray other than small "wing" trays on the document handler itself. The fanfolded input stack occupies a ridge-defined space on the top of the copier adjacent the document handler and feeds CF from that stack directly into the document handler. That limits the height of a CF stack which can reliably feed.

By way of general background, the art of original document handling for copiers has been intensively pursued in recent years. Various systems have been provided for automatic or semiautomatic feeding of documents to be copied to and over the imaging station of the copier. The documents are normally fed over the surface of a transparent platen into a registered copying position on the platen, and then off the platen. Such automatic or semiautomatic document handlers eliminate the need for the operator to place and align each document on the platen by hand. This is a highly desirable feature for copiers. Document handlers can automatically feed documents as fast as they can be copied, which cannot be done manually with higher speed copiers, thus enabling the full utilization or productivity of higher speed copiers. Lower cost, more compact, and lighter weight document handlers are particularly desired. This is particularly true in the normal arrangements in which the document feeder is a part of and/or provides a repositionable (liftable) platen cover unit overlying the copier platen.

Even with smaller and slower copying rate copiers, it has become increasingly desirable to provide at least semiautomatic document handling, allowing an operator to initially load originals into an input of a copier document handler, with the document handler automatically providing the final deskewing, registration and feeding of the documents into and through the copying position, and then ejecting the documents automatically. However, for compact and low cost copiers, an appropriate document handler must also be simple, low cost and compact.

A document handling system preferably utilizes the existing or generally conventional copier optical imaging system of the copier on which it is mounted, including the external transparent copying window (known as the platen) of the copier.

One type of original document presenting particular problems, because of its differences and general incompatibility with conventional document sheet handling, is computer form web, or "CF" as referred to herein. The increased use of computers has increased the number of "CF" documents and the need for convenience copies thereof. This is the well known elongate web of odd-sized paper typically provided as the output of conventional computer printers. It comes in several different widths, but is usually wider than most standard paper sizes. Also, conventionally it has round "sprocket holes" at regular ½ inch (12.7 mm) intervals (center-to-center) extending along and closely adjacent both edges. These holes are provided for sprocket or pin feeding the web. Generally CF web is folded and stacked in zig-zag or "fan folded" form, and thus CF web is also called "fan fold". This folding is enabled by partial perforations or slits extending transversely across the web at regular intervals along the web, and these also provide tearing or "burst" lines. It is not desirable to "burst" or separate the CF web in many cases, yet in many cases it is desired to make registered individual sheet copies of segments of the CF web, especially reduction copying onto conventional size paper copy sheets.

As used herein in relation to CF, a web segment or page is the CF web segment, portion, frame or unseparated sheet to be copied onto a copy sheet. This often, but not necessarily, corresponds to the area between the partial transverse slits, known as "perfs", provided for "bursting" the CF web into individual sheets. The present system does not require such separation or bursting of a CF web for its copying.

Illustrated herein is an exemplary CF web document feeder integral with an existing recirculating document handling system or "RDH" over a copier platen. However the present system may be used with copiers having no, or various other, document handling systems. It may be used in combination with various document handlers, particularly those which are dual mode (RDH/SADH) types, and is compatible with either precollation or post-collation copying. These copying modes are further described, for example, in U.S. Pat. Nos. 4,080,063 issued Mar. 21, 1978 to D. J. Stemmle; 4,212,457 issued July 15, 1980 to J. Guenther; or 4,176,945 issued Dec. 4, 1979 to R. C. Holzhauser et al..

A severe limitation on over-platen document feeding and registering systems is that they must have sufficient feeding force to reliably and accurately incrementally feed the document, but not forces which can damage the document. In the case of CF web, for most copiers this means rapidly and accurately starting and stopping the web for each web increment being copied. The document feeding system should also minimize the introduction of document sheet skewing in the feeding of the document from the document stack to the registration or imaging position on the platen. Yet it is also desirable not to have excessive drag on the documents even though the guides and control surfaces to maintain positional control introduce drag forces. The document areas to be copied must be maintained within close positional tolerances on both axis over the platen and held close to the platen (within focus) to be properly imaged.

Usually a CF web is directly mechanically fed without any slippage with a sprocket wheel or a belt with pins (a "tractor" or "Kidder" drive) mating with the sprocket holes along both edges of the CF web. Various examples of such computer form feeders (CFF) are known in the art, and some are cited below. Note, e.g., U.S. Statutory Invention Registration (SIR) No. H17 published Feb. 4, 1986 by S. J. Wenthe, Jr.. However, a serious disadvantage of the use of such a pin or tractor feeder for a copier is that such a feeder cannot also feed conventional unperforated original document sheets, and thus separate document handler, units separately used, are conventional.

There have also been recently developed document feeders for copiers using friction feeding for both CF and conventional documents. Examples are disclosed in U.S. Pat. Nos. 4,485,949 issued Dec. 4, 1984 and 4,526,309 issued July 2, 1985 and references cited therein. However, such non-sprocket CF web document feeders have an additional problem of maintaining registration of the CF web segments to be copied.

In contrast, with a pin or sprocket drive CF the incremental advance of the tractor or other pin-drive system, by, e.g., a servo or stepper motor, equals that of the CF web increment, because there is no slippage, and thus only initial registration is needed. Also, lateral registration is maintained by the sprocket positions. (The present system can alternatively utilize such a conventional and very low-cost non-slip feeder, if desired.)

The incremental starting and stopping of the CF web greatly increases the feeding forces on the CF document feedre and feeding difficulties. However, if a CF web is simply continuously moved over an imaging station, it is difficult or impossible to obtain properly registered copying of selectable portions of the CF web onto conventional individual copy sheets. That is, to repeatedly automatically copy one complete frame or section of the CF web onto only one copy sheet, or onto several copy sheets when more than one copy of that one CF frame or segment is desired. Since there is only one document lead edge for the CF web, conventional lead edge registration cannot be used for subsequent web frames. Nor can document feeding errors be corrected in this manner, and thus they may be cumulative for the subsequent web frames. Nor can the pitch distance or interval between CF frames be changed since they are directly connected. Lateral misregistration or skew feeding of the CF web also tends to be cumulative, i. e. increasing with the length of CF web which is fed. Furthermore, a continuously moving type of CFF system is not readily compatible with normal full frame (full size platen) copying of stationary individual document sheets, which is particularly desirable for multiple copies.

U.S. Pat. No. 4,320,960 issued Mar. 23, 1982 (filed Sept. 17, 1979) to Joseph W. Ward and Russell G. Schroeder is a recent example of a commercial tractor sprocket drive computer forms feeder (CFF) for a xerographic copier. It relates to the Xerox "9400" copier accessory unit for feeding computer forms automatically to the copier platen in a controlled manner. (Very similar CFF disclosures, with the same filing date as said U.S. Pat. No. 4,320,960, are in U.S. Pat. Nos. 4,264,189; 4,264,200; 4,299,477; and 4,313,672.)

Other examples of sprocket (pin or tractor) drive CFF for copiers are disclosed in U.S. Pat. Nos. 3,446,554 issued May 27, 1969 to A. M. Hitchcock et al (known as the "inch worm" or "2400 CFP" feeder); 3,804,514 issued Apr. 16, 1974 to Stephan A. Jasinski; 3,831,829 issued Aug. 27, 1974 to L. S. Karpisek; 3,973,846 issued Aug. 10, 1976 to W. A. Sullivan et al; 3,977,780 issued Aug. 31, 1976 to J. R. Cassano et al;

3,994,426 issued Nov. 30, 1976 to George J. Zahradnik et al.; 3,997,093 issued Dec. 14, 1976 to Masahiro Aizwa et al; 4,079,876 issued Mar. 21, 1978 to M. A. Malachowski; 4,087,172 issued May 2, 1978 to M. C. Van Dongen; 4,300,710 issued Nov. 17, 1981 to R. Clark Du Bois, et al; and 4,334,764 issued June 15, 1982 to L. E. J. Rawson, et al; and in the EPO Publication No. 0 005 043 of EPC Application No. 79300627.1 on Oct. 31, 1979 corresponding to abandoned U.S. application Ser. No. 896,877 filed Apr. 17, 1978 by John F. Gardner and Robert L. Greco. Some of the above CF feeders count pulses generated by the document feeding sprocket drive mechanism itself to control the CF web stopping and starting, as may be utilized herein. A CFF feeding control is also taught in "Research Disclosure" Bulletin Publication No. 23018, pp. 227–9, June 1983.

Other (non-sprocket drive frictional) CF feeders are known for microfilm cameras, e. g. U.S. Pat. No. 3,255,662 issued June 14, 1966 to D. D. Call and its divisional U.S. Pat. No. 3,442,503. These patents are of interest for their disclosure in FIGS. 3A and Col. 11 (middle) of a humped CF restacking plate 178.

As to another feature, prior art re pivotal document sheet trays for copiers includes U.S. Pat. No. 3,888,584 issued June 10, 1975 to C. A. Smith. The upper one of two overlying trays is pivotal to alternatively utilize the bottom tray as a book support.

A general disclosed feature herein is to improve the incremental feeding of a CF web to or from a copier platen for copying.

A further general feature is to provide a more compact and lower cost web document feeding accessory for various conventional copiers.

Another general feature disclosed herein is to provide, for a continuous form document feeder for a copier, for incrementally feeding a computer form or the like web document from a fan-folded stack thereof to the imaging station of a copier with a web feeder, an improvement in the supply hopper system from which the fan-fold web stack is stacked and from which the web is unfolded and fed out to be copied.

The present invention overcomes various of the above-discussed problems and provides various of the above and other features and advantages.

A feature of the specific embodiment disclosed herein is to provide for a copier with a dual mode document sheets, an improved and plural mode system for the input and/or output of said documents comprising:

a first document stacking unit with stationary first surface means providing both an operator work space and a tray for individual sheets in document feeding communication with said document handling system of said copier;

said first surface means also defining a computer forms web guide aperture;

said first surface means and said computer forms web guide aperture in said first surface means being in computer form web document feeding communication with said document handling system of said copier;

a second document stacking unit integral said first document unit and comprising computer forms web stacking tray means;

and means for repositioning and maintaining said computer forms web stacking tray means into an operating position spaced below said first surface;

said operating position being centrally below said computer forms web guide aperture in said first surface means, for operatively supporting a fan-folded stack of said computer forms web being fed through said computer forms web guide aperture.

Further features provided by the system disclosed herein, individually or in combination, include those wherein said:

second document stacking unit is pivotably closable from said operating position to a position against said first document stacking unit to underlie a substantial portion thereof but not interfere with the operation thereof, and wherein said second document stacking unit is pivotably openable into said operating position; and wherein suspension means are provided to support said second document stacking unit by suspension from said first document stacking unit in said operating position.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below. The present invention will be better understood by reference to this description of this embodiment thereof, including the drawing figures (approximately to scale), wherein.

Figure 1:
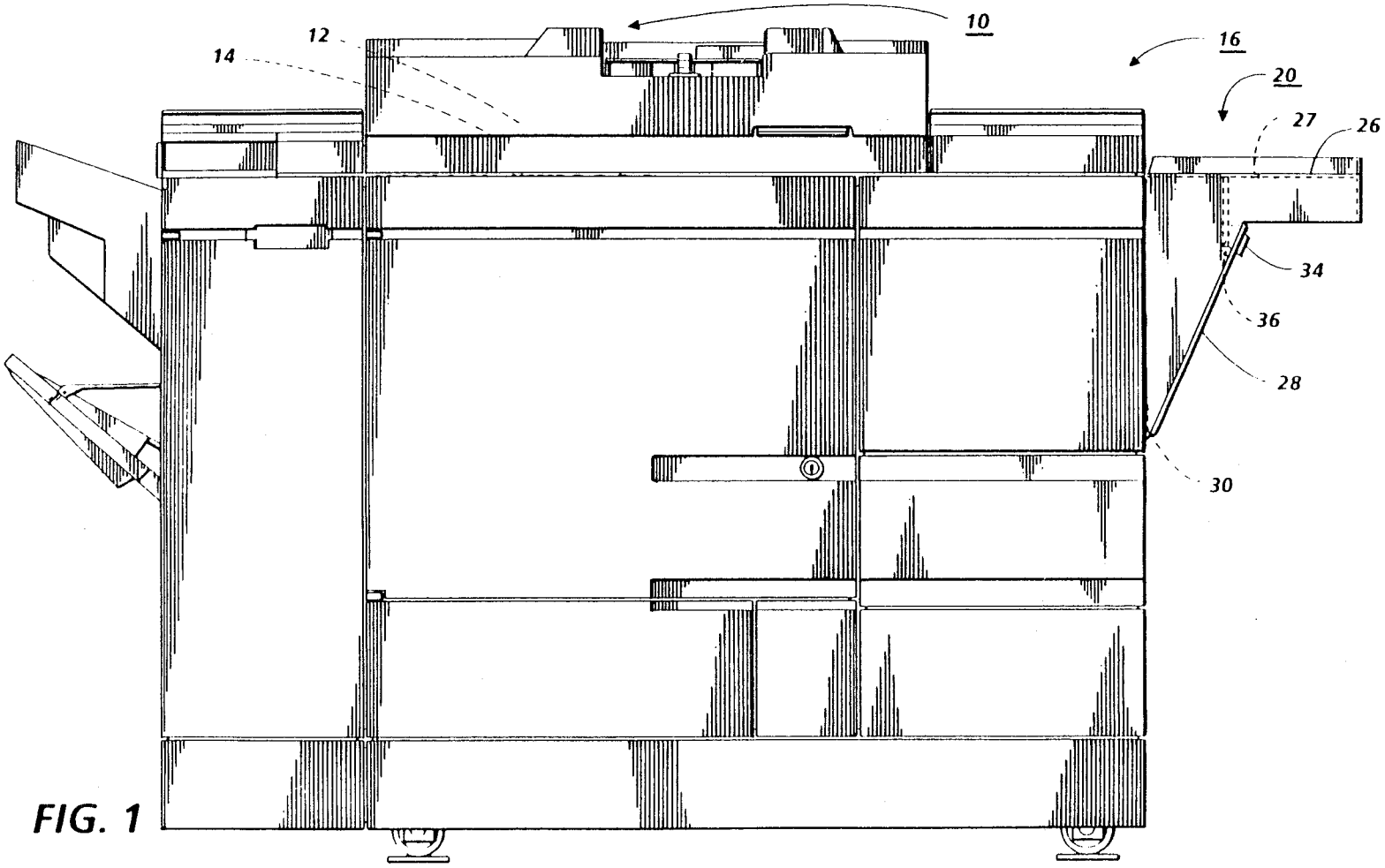
FIG. 1 is a front view of one example of the system of the present invention providing the features described above, incorporated onto an exemplary commercial xerographic copier and its associated exemplary document handler.
Figure 2:
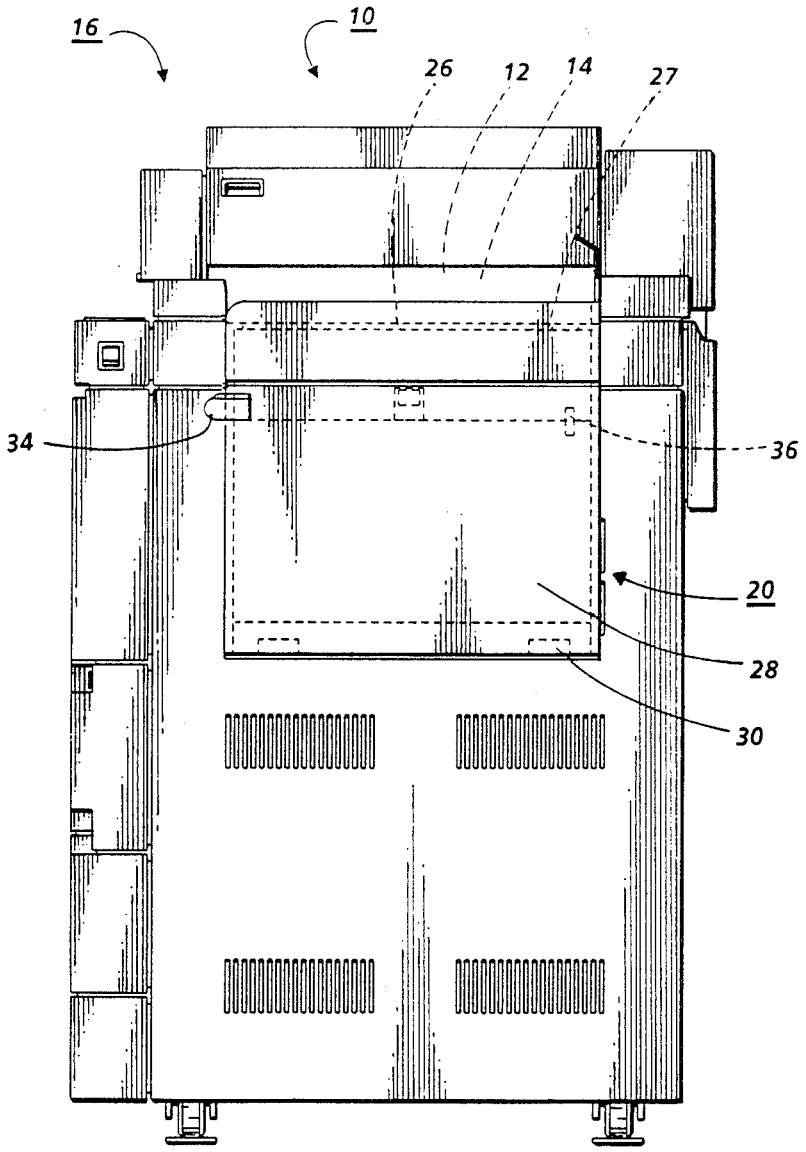
FIG. 2 is an end plan view thereof.

Describing now in further detail the specific example illustrated in the Figures, there is shown a document handling system 10, including a document platen transport or feeder system 12 thereof, as further disclosed for example in U.S. Pat. Nos. 4,579,444, 4,579,325, and/or 4,589,651 or the like, for sequentially transporting documents onto and over the conventional platen 14 of a copier 16. The document handling system 10 here is a dual mode document feeder for handling both computer forms web (CF) and individual document sheets. This platen transport system 12 of the document feeder 10 is also conventionally adapted to automatically register each document sheet, or segment or page of CF web, at an appropriate registration position on the platen 14.

The exemplary copier 16 shown here is the well known "Xerox" "1065" xerographic copier, illustrated and described in various patents. The documents are conventionally illuminated and copied by being imaged onto an image area of the photoreceptor of the copier 16. This is merely an example, since the invention is applicable to any copier.

The exemplary document handling system or feeder 10 and its platen transport system 12 illustrated here may be readily modified, or used with different copiers. This one has two separate document inputs, a recirculating or RDH input stacking tray on top for loading conventional documents, and a separate semiautomatic or SADH side entrance at approximately the level of the top of the copier for semiautomatic document handling, especially for larger documents, and unburst CF web in particular. The document output for the SADH input is at the opposite side of the feeder 10, also approximately at the level of the top of the copier. This is merely an example, since the invention is applicable to almost any copier document feeder, although the plural mode function of the invention makes it particularly useful for such a dual mode feeder which takes in and ejects both types of documents from the same input and output locations.

Disclosed herein is an improved and plural mode integral unit 20 document tray and guide system. The entire system or unit 20 is easily mountable as a single unit to one end of the copier 16. Preferably one is mounted at each end for handling both the input and output of both types of documents and providing increased work space. For convenience, only the input end unit 20 need be illustrated here, since the unit mounted at the other end may be the same, or a mirror image version thereof if the tray side walls illustrated are desired to be at the rear. If the copy sheet output tray, like the one illustrated, might interfere with mounting either one of the units 20, either can be relocated or modified. Alternatively, the copy sheet output tray can be relocated or modified. Each unit 20 can be mounted simply by inserting two hooks thereon into mounting slots provided near the top of each end of the copier.

The unit 20 here includes a first or upper document stacking tray member 26 providing either or both an operator work space and a tray for individual sheets fed to or from the copier document feeder 10. The central area of this first tray 26 is transversely apertured at 27 as shown to define a narrow but elongated CF guide aperture 27 therein. This aperture 27 is approximately one cm. wide, e.g., 0.6 cm., and slightly longer transversely than the width of the maximum width CF web to be fed, e.g., 46 cm. This is provided by making the tray 26 slightly wider than this elongate slot dimension. This aperture 27 guides therethrough a CF web document 22 feeding to or from the document feeder 10, and to or from a CF stack 24. Thus, the CF web feeds through this first tray 26, at the position defined and controlled and limited by the position and ends of the narrow slot 27.

Figure 3:
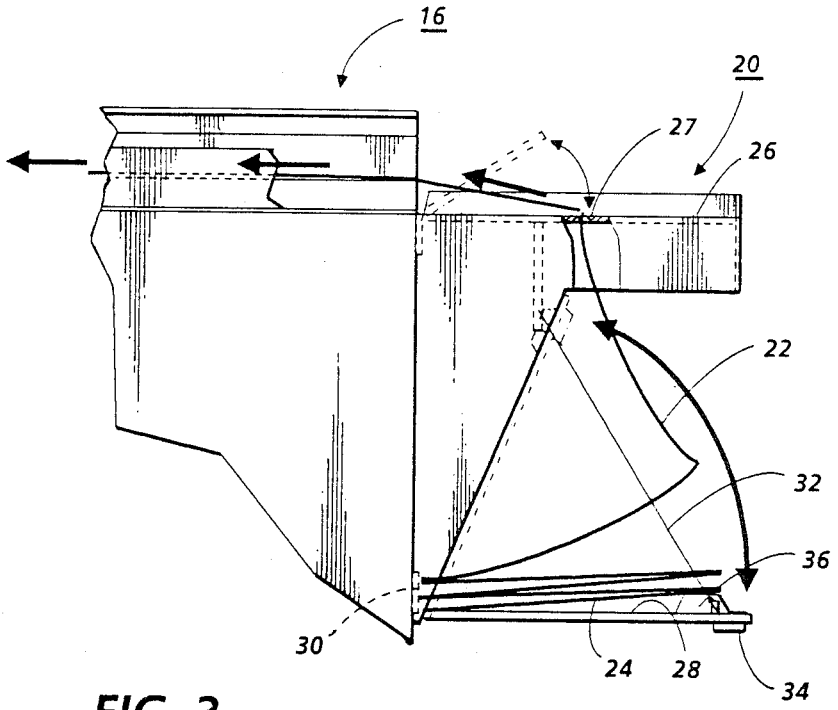
FIG. 3 is a partial and enlarged front view of the system of FIGS. 1 and 2 in its open or CF operating position, handling a CF web document.

For the assistance of the operator in initially threading the CF web through the slot 27, the portion of the upper tray 26 between one side of the slot 27 and the copier may be pivotally lifted upwardly by the operator, as shown in FIG. 3, and this lifting may be assisted by a finger hole or the like. When this member is lifted, a greatly enlarged slot opening is thereby provided through which the initial portion of the CF web can be reached and pulled up therethrough. This member is otherwise automatically closed.

The unit 20 also includes an integral second document stacking tray member 28 for properly supporting a fan-folded stack 24 of CF in an operating position. This second tray 28 is pivotally mounted to the first tray member 26 by a hinge or hinges 30, and compactly closeable up against and covering the bottom of the first tray member 26 to provide an attractive and compact closed unit 20. A magnetic latch may be provided as shown to hold the lower tray 28 closed. A handle 34 may also be provided to open and close the second tray 28. In this closed position the second tray 28 does not interfere with the operation of the first tray 26 for either conventional documents or as a work space.

The second tray 28 is repositionable into a substantially horizontal operating position appropriately spaced below the first tray 26 surface and centrally below the CF guide aperture 27 directly in appropriate CF feeding communication therewith for improved CF feeding/stacking. A preferred said spacing between the two tray surfaces is slightly greater than the distance of one web segment between the CF web fold lines. A stack deflector 36 may be provided on the lower tray 28 stacking surface for arching the stack 24 and/or making it easier for the operator to reach under the stack to remove it.

When the unit 20 is used for CF document in-feeding, CF web 22 is (desirably) pulled centrally up through the guide aperture 27 from the top of the input CF stack 24 which has been stacked onto the opened lower tray 28. The aperture 27 aides CF feeding and prevents skewing and otherwise desirably controls the web position and movement. When the unit is used as a CF output or take-up unit, the combination of the position and spacing of the aperture 27 relative to the tray 28 provides for more reliable and consistent proper fan-fold restacking of the CF web. In either case the aperture 27 provides for a controlled right angle turn or deflection of the web, and for a desirably substantially linear feeding of the web between that position and the document feeder 10, supported by the planar surface of the first tray 26, and for substantially linear feeding of the web between the tray 28 and the aperture 27.

A simple suspension system 32 is provided to suspend the second tray 28 in the operating position from the first tray 26 so that it does not have to cantilever support the weight of the CF stack. This may be provided by two clear plastic tapes or cords respectively mounted as shown to the two outside corners of the lower tray 28 and adjacent the lower inside corners of the upper tray 26. These supports desirably disappear inside the unit 20 when the unit is closed.

Figure 4:
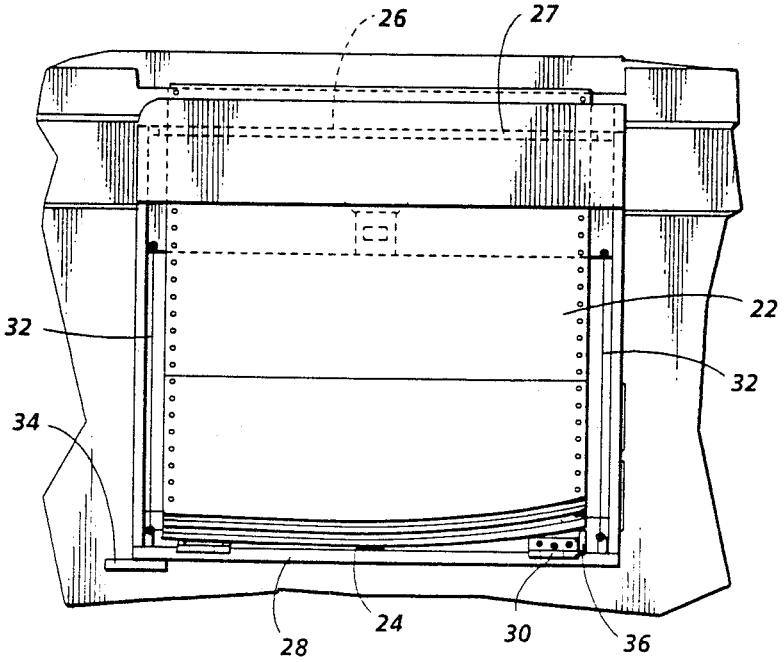
FIG. 4 is a top view of the FIG. 3 operating position.

Various of the above-described references may be referred to for further details of components. To reiterate, as particularly shown in FIGS. 3 and 4, the specific disclosure herein shows a dual mode document tray and and computer forms accessory kit system 20 for feeding a continuous form web document, such as a CF 22, from a fan-folded input stack 24 of said web 22. The web 22 is fed incrementally across the platen 14 by the document feeder 10 for copying and then to a similar output stack (not illustrated) wherein the web 22 is restacked in its conventional zig-zag or fan-folded format. More specifically, the fan-folded web 22 is initially normally stacked 24 in a computer forms input tray or supply hopper 28. Web 22 is then unfolded and fed out from the top of the stack 24 to be copied by being pulled over the platen 14. From this there the web 22 is restacked as an output stack in an output tray at the other side of the copier 16.

The computer forms feeder accessory unit 20 features provided herein include improvements in the input tray or supply hopper and its guides which reduce fluctuations in the position and resistance to feeding of the CF web by the web drive unit, therefore improving registration, without requiring, as has heretofore often been practiced, a large vertical wall or bail, or other large, space-consuming, web guides. The present system enables the use of low torque, low power, and low cost drives for the CF web 22, even, for example, those such as are utilized in typewriters or lowcost computer printers for home computers or the like. Since both the web drive unit (here the same document handler as for conventional documents) the input tray unit, and its integral guides, are all simple and low cost and compact items, the entire computer forms feeder accessory unit 20 can be provided for an existing copier to provide automatic computer forms or other web document feeding therefor at little additional cost and no other modification of the existing copier.

The CF supply hopper or input tray 28 may have a generally conventional, generally horizontal main stack supporting floor for supporting a large stack 24 of fanfold web. This is underneath the upper tray 26, which provides another tray and work surface contiguous with or slightly below the upper surface of the copier 10 and also functions as a web path guide.

To restate some of the additional advantages to the disclosed system, unlike conventional "wing" trays attached to the document feeder, which throws documents or other papers on the floor whenever the document feeder must be lifted, e.g. for manual document copying, and otherwise covers up (overlies) otherwise usable work space on the top surface of the copier, the plural mode upper tray member 26 disclosed herein also provides a stationary and usable work surface extension, desirably contiguous with and extending rather than overlying the top surface of the copier. Integral and operatively associated with this tray member 26 is a CF tray portion 28 for which the dual mode tray provides the CF web feeding guide to or from both the web stack and the platen. Furthermore, this integral CF tray portion 28 is readily pivotably closeable against the dual mode tray portion to provide a much more attractive "contoured" machine appearance, with no increase in overall machine size.

While the embodiments disclosed herein are preferred, it will be appreciated from this teaching that various alternatives, modifications, variations or improvements therein may be made by those skilled in the art, which are intended to be encompassed by the following claims:

What is claimed is:

1. For a copier with a dual mode document handling system for handling both computer forms web and indiviaual document sheets, a plural mode system for the input and/or output of said documents comprising:

a first document stacking unit with stationary first surface means providing both an operator work space and a tray for individual sheets in document feeding communication with said document handling system of said copier;

said first surface means also defining a computer forms web guide aperture;

said first surface means and said computer forms web guide aperture in said first surface means being in computer form web document feeding communication with said document handling system of said copier;

a second document stacking unit integral with said first document unit and comprising computer forms web stacking tray means;

and means for repositioning and maintaining said computer forms web stacking tray means into an operating position spaced below said first surface;

said operating position being centrally below said computer forms web guide aperture in said first surface means, for operatively supporting a fanfolded stack of said computer forms web being fed through said computer forms web guide aperture;

wherein said second document stacking unit is pivotably closeable from said operating position to a position against said first document stacking unit to underlie a substantial portion thereof but not interfere with the operation thereof, and wherein said second document stacking unit is pivotably openable into said operating position.

2. The system of claim 1 wherein suspension means are provided to support said second document stacking unit by suspension from said first document stacking unit in said operating position.

* * * * *